US006397705B1

(12) United States Patent
Hsieh

(10) Patent No.: US 6,397,705 B1
(45) Date of Patent: Jun. 4, 2002

(54) DIRECTION CONTROL ARRANGEMENT FOR A WRENCH OR THE LIKE

(76) Inventor: Chih-Ching Hsieh, No. 64, Lane 107, Liang Tsun Rd., Fong Yuan City, Taichung Hsien (TW)

( * ) Notice: Subject to any disclaimer, the term of this patent is extended or adjusted under 35 U.S.C. 154(b) by 0 days.

(21) Appl. No.: 09/610,961

(22) Filed: Jul. 6, 2000

(51) Int. Cl.[7] ..... B25B 13/46
(52) U.S. Cl. ..... 81/63.1; 192/43.2
(58) Field of Search ..... 81/60, 63.1, 63.2, 81/125, 62, 61, 63; 192/43.2

(56) References Cited

U.S. PATENT DOCUMENTS 2,718,806 A * 9/1955 Clark ..... 81/125
2,993,397 A * 7/1961 Albertson et al. ..... 81/125
3,005,367 A * 10/1961 Vose ..... 81/125
3,577,816 A * 5/1971 Alexander ..... 81/63.1
3,621,739 A * 11/1971 Seablom ..... 81/63.1 X
4,818,157 A * 4/1989 Kouvelis ..... 81/125
4,991,468 A * 2/1991 Lee ..... 81/60
5,582,081 A * 12/1996 Lin ..... 81/63.1
6,070,503 A * 6/2000 Shiao ..... 81/63.2

* cited by examiner

*Primary Examiner*—D. S. Meislin
(74) *Attorney, Agent, or Firm*—Varndell & Varndell, PLLC

(57) ABSTRACT

A direction control arrangement for wrench is constructed to include a body defining a box and a transverse through hole across the box, two stop elements respectively mounted in the transverse through hole at two opposite sides of the box, two steel balls respectively mounted in two distal ends of the transverse through hole, two spring members respectively mounted in the transverse through hole and connected between the stop elements and the steel balls to push the stop elements and the steel balls outwards in reversed directions, and a resilient retainer ring mounted on the body to stop the steel balls from escaping out of the body, the resilient retainer ring having two protruded receiving portions adapted to receive the steel balls alternatively for controlling te working direction of the wrench.

1 Claim, 12 Drawing Sheets

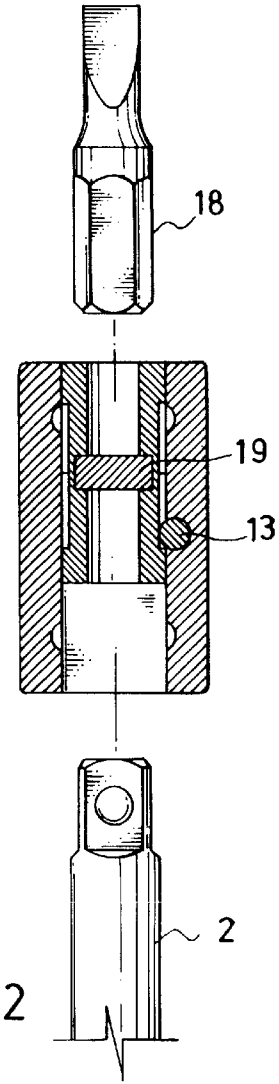
Fig. 12
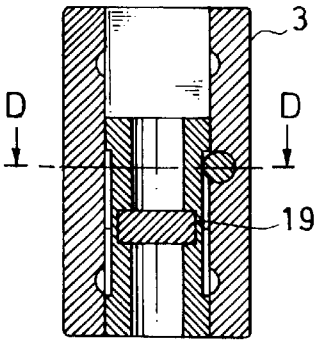
Fig. 11
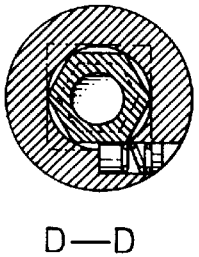

DIRECTION CONTROL ARRANGEMENT FOR A WRENCH OR THE LIKE

BACKGROUND AND SUMMARY OF THE INVENTION

The present invention relates to wrenches, and more particulary to a direction control arrangement for a reversible wrench, which is inexpensive to manufacture and easy to install.

A variety of wrenches including open-end wrenches, box-end wrenches, socket wrenches, hex-wrenches, ratchet wrenches, and etc. have been disclosed, and have appeared on the market. Nowadays, most wrenches are made reversible for convenient use. FIGS. from 1 through 3 show three different conventional reversible ratchet wrenches. These reversible ratchet wrenches are commonly have a direction control mechanism for controlling the working direction of the wrench. However, the direction control mechanism according to these reversible ratchet wrenches is expensive to manufacture and complicated to install. FIG. 4 shows a reversible thin-panel wrench. The direction control mechanism of this structure of reversible thin-panel does not eliminate the aforesaid drawbacks. FIG. 5 shows another structure of reversible thin-panel wrench. This wrench produces much noise during its operation.

The present invention has been accomplished under the circumstances in view. It is the main object of the present invention to provide a direction control arrangement for a reversible wrench, which is inexpensive to manufacture, and easy to install. According to one embodiment of the presnet invention, the direction control arrangement comprises a body defining a box and a transverse through hole across the box, two stop elements respectively mounted in the transverse through hole at two opposite sides of the box, two steel balls respectively mounted in two distal ends of te transverse through hole, two spring members respectively mounted in the transverse through hole and connected between the stop elements and the steel balls to push the stop elements and the steel balls outward in reversed directions, and a resilient retainer ring mounted on the body to stop the steel balls from escaping out of the body, the resilient retainer ring having two protruded receiving portions adapted to received the steel balls alternatively for controlling the working direction of the wrench. According to another embodiment of the present invention, the stop elements are respectively supported on the spring members and disposed at different elevationsl in the box inside the body.

BRIEF DESCRIPTION OF THE DRAWINGS

FIG. 11 is a sectional view of another alternate form of the present invention.

FIG. 12 shows an application example of the embodiment shown in FIG. 11.

DETAILED DESCRIPTION OF THE PREFERRED EMBODIMENT

Figure 6:
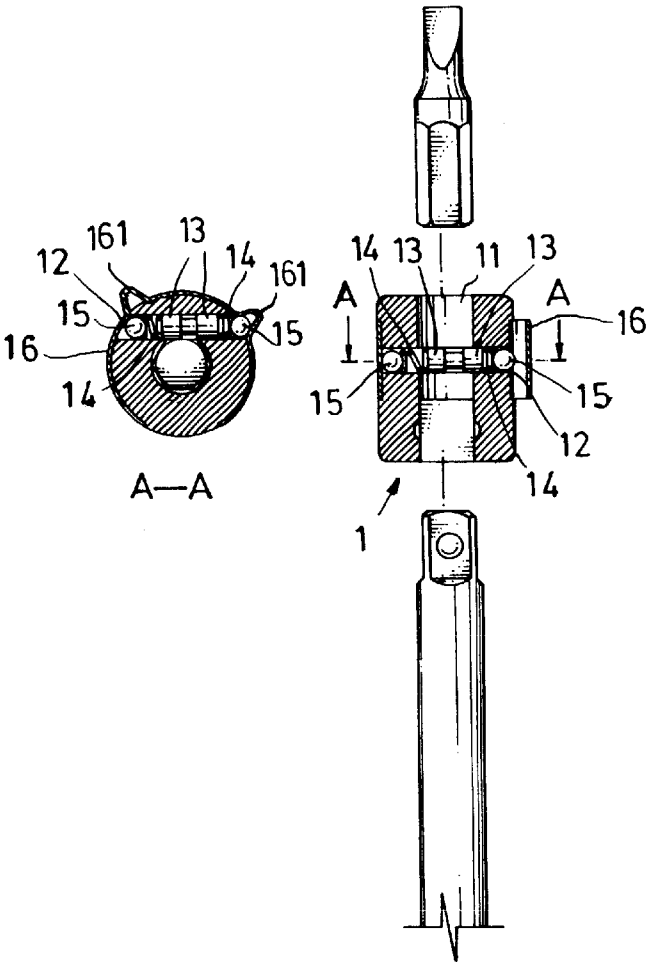
FIG. 6 is a sectional view of the present invention.

Referring to FIG. 6, the direction control arrangement for a reversible wrench according to the present invention comprises a body 1 defining a box 11 and a transverse through hole 12 across the box 11, two stop elements 13 respectively mounted in the transverse through hole 12 at two opposite sides of the box 11, two steel balls 15 respectively mounted in two distal ends of the transverse through hole 12, two spring members 14 respectively mounted in the transverse through hole 12 and connected between the stop elements 13 and the steel balls 15 to push the stop and a resilient retainer ring 16 mounted around the periphery of the body 1 to stop the steel balls 15 from escaping out of the body 1. The resilient retainer ring 16 comprises two protruded receiving portions 161 adapted to receive the steel balls 15 alternatively for controlling the working direction of the reversible wrench.

Figure 1:
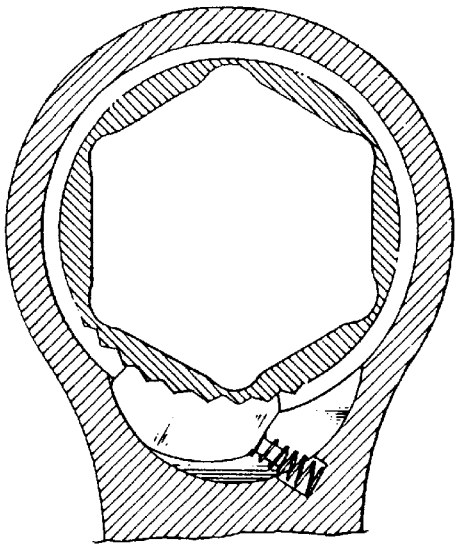
Fig. 1 PRIOR ART
FIG. 1 is a sectional view of a ratchet wrench according to the prior art.
Figure 2:
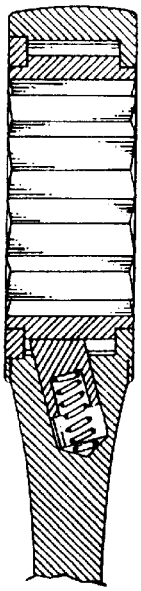
Fig. 2 PRIOR ART
FIG. 2 is a sectional view of another structure of ratchet wrench according to the prior art.
Figure 3:
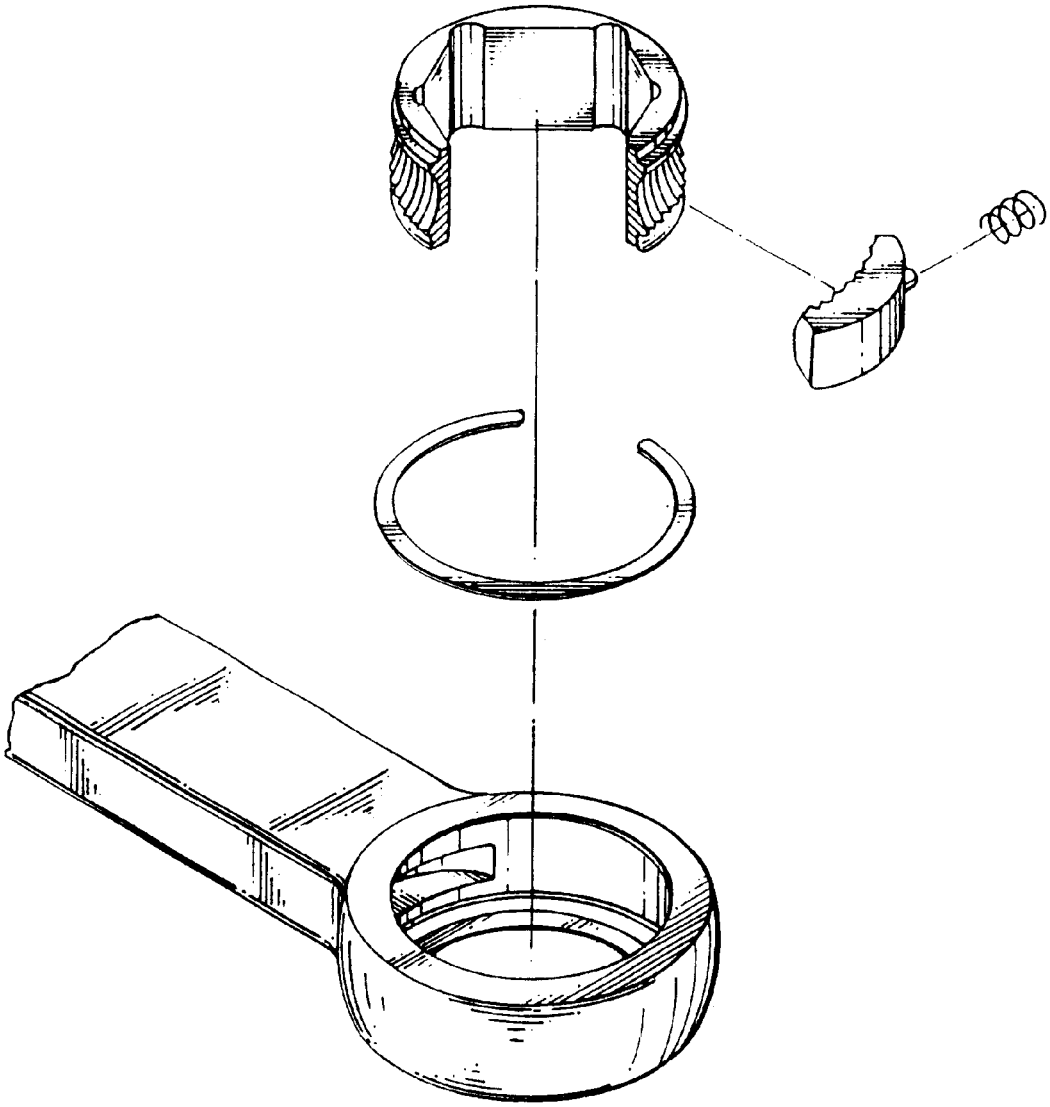
Fig. 3 PRIOR ART
FIG. 3 is an exploded view of still another structure of ratchet wrench according to the prior art.
Figure 4:
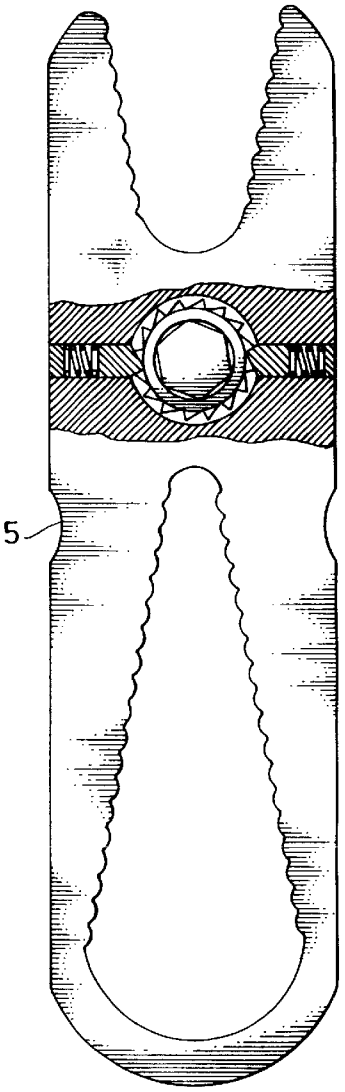
FIG. 4 illustrates a thin-panel wrench according to the prior art.
Figure 5:
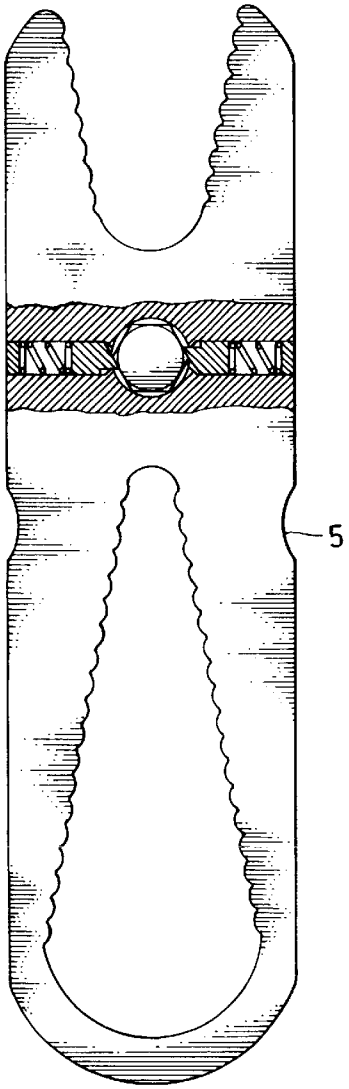
FIG. 5 illustrates another structure of thin-panel wrench according to the prior art.
Figure 7:
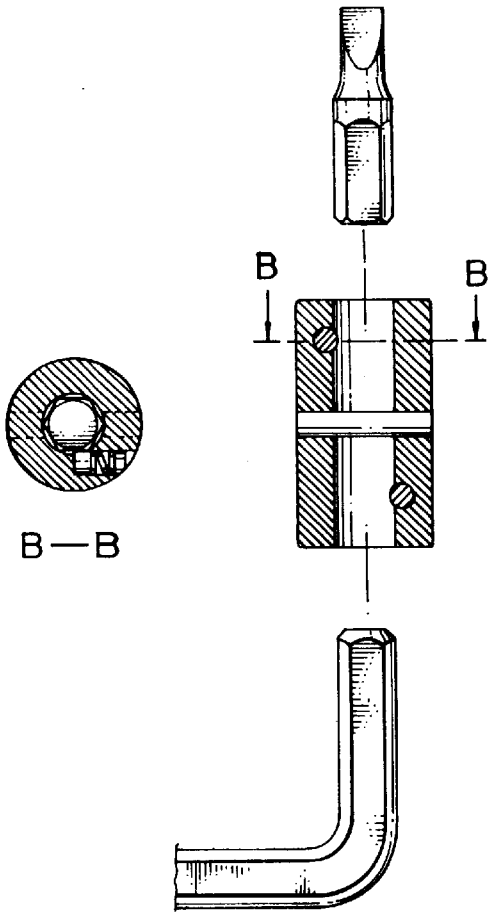
FIG. 7 is a sectional view of an alternate form of the present invention.

FIG. 7 shows an alternative form of the present invention. According to this alternative form, the stop elements 13 are supported on the respective spring members 14 and arranged at different elevations in the box 11 of the body 1, and a sleeve is mounted on the body 1 to hold the stop elements 13 and spring members 14 in the body 1 (see also FIG. 6 for corresponding reference numbers).

Figure 8:
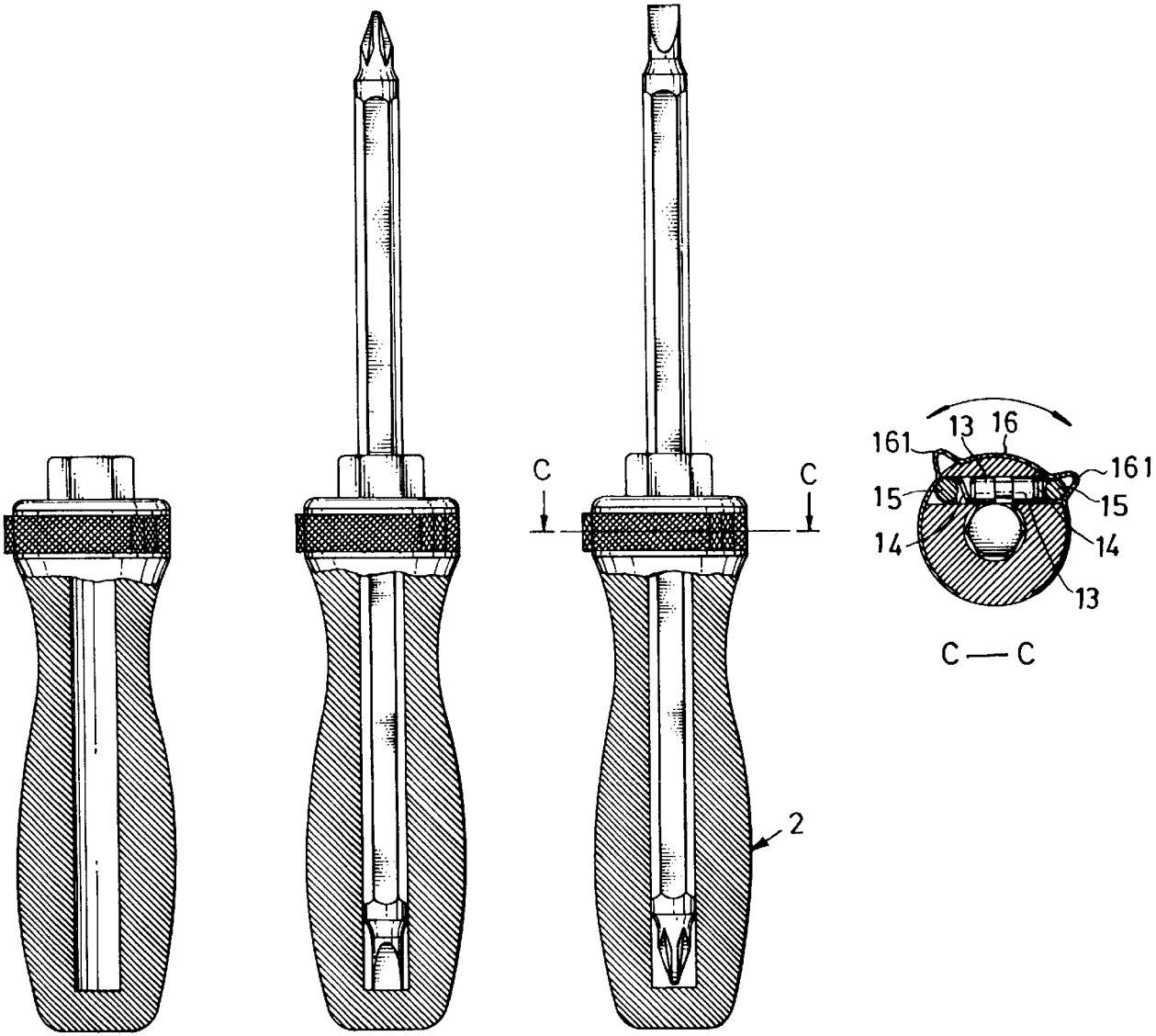
FIG. 8 illustrates an application example of the present invention.
Figure 10:
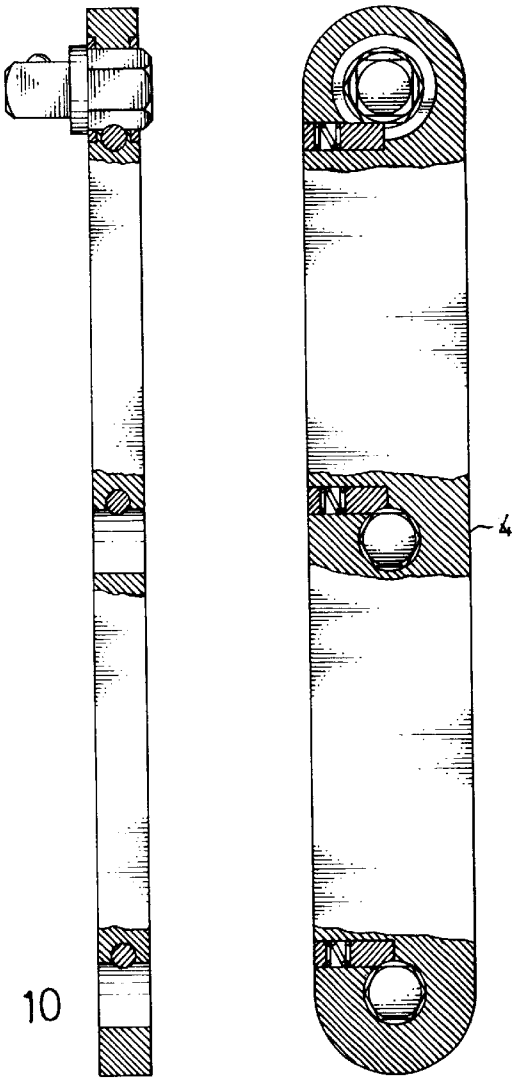
FIG. 10 illustrates still another application example of the present invention.
Figure 9:
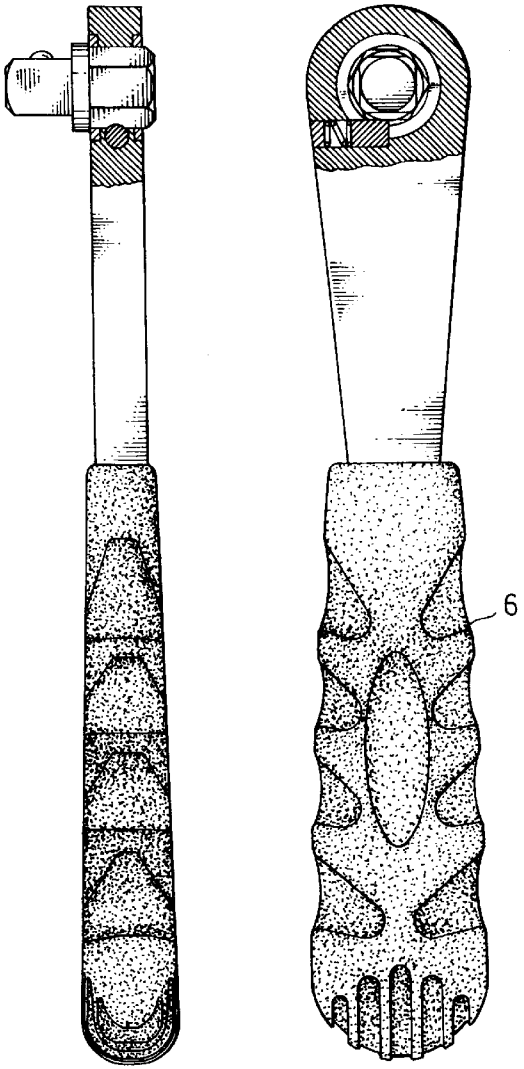
FIG. 9 illustrates another application example of the present invention.
Figure 21:
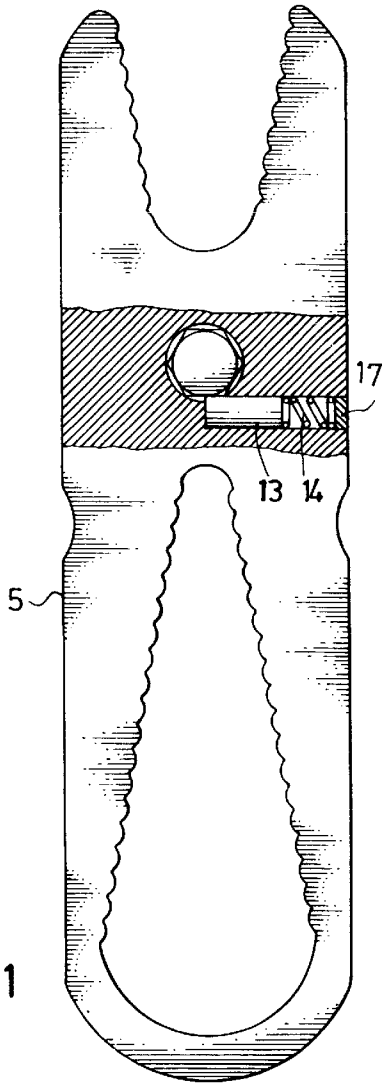
FIG. 21 is a sectional assembly view of FIG. 20.
Figure 20:
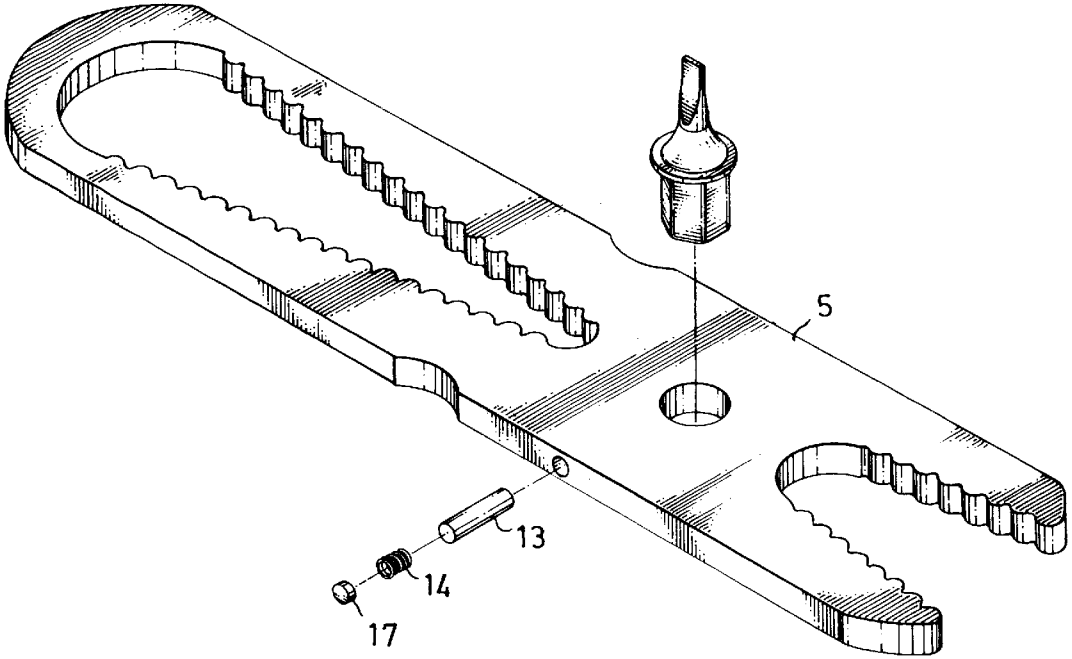
FIG. 20 is an exploded view showing the present invention used in a thin-panel wrench.

The aforesaid arrangement can be used in screwdrivers (see FIG. 8), ratchet wrenches 6 (see FIG. 9), wrenches 4 (see FIG. 10), socket 3 (see FIGS. 11 and 12), thin-panel wrenches 5 (see FIGS. 20 and 21).

Figure 13:
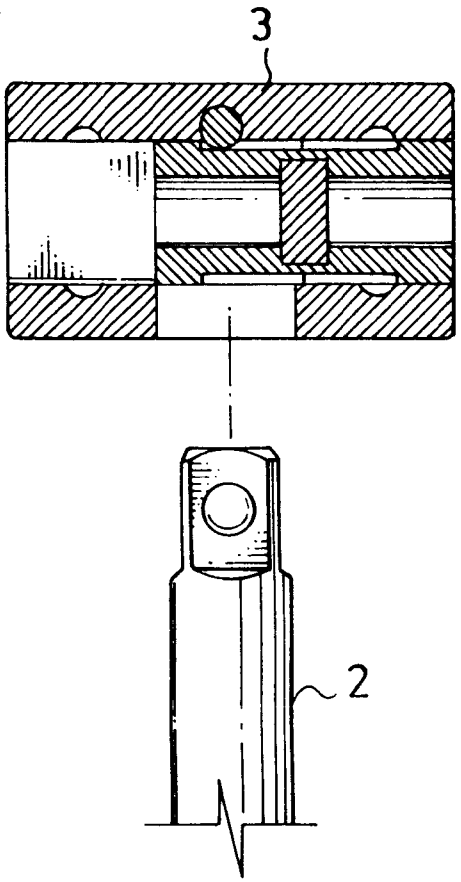
FIG. 13 is a sectional view of still another alternate form of the present invention.

Referring to FIGS. 11, 12 and 13, a magnetic element 19 is installed in the box of the socket 3 (see FIGS. 11 and 13) or screwdriver 2 (see FIG. 12), and adapted to attract the bit 18.

Figure 15:
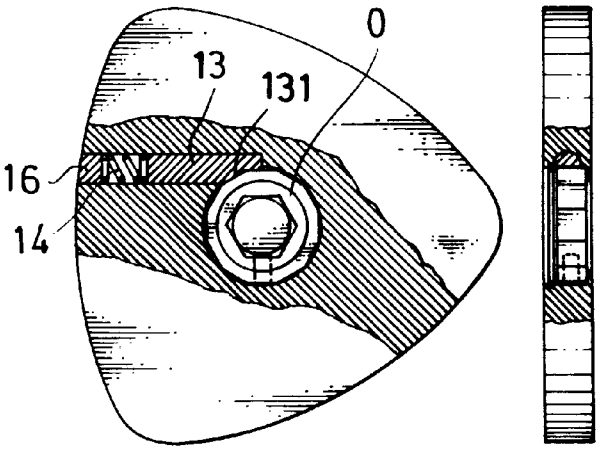
FIG. 15 is similar to FIG. 14 but showing a different detour of the wrench.
Figure 14:
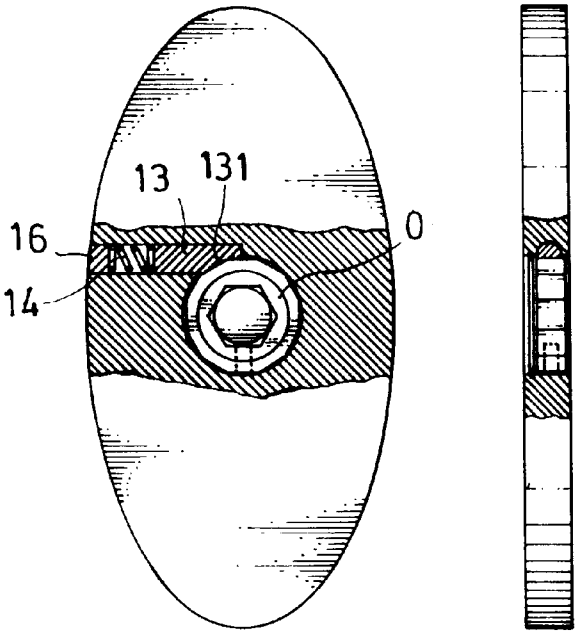
FIG. 14 is a sectional view showing the engagement notch of the stop member engaged with the polygonal periphery of the inserted bit.
Figure 17:
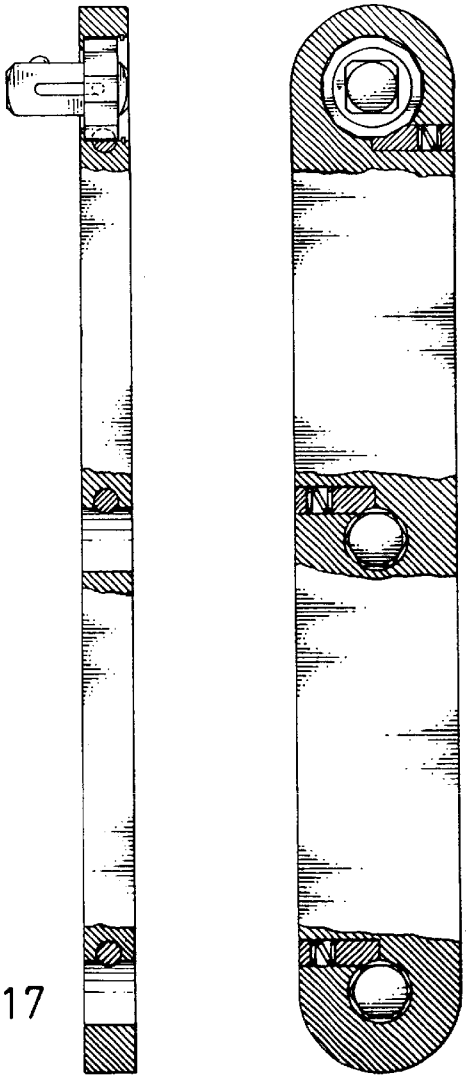
FIG. 17 shows still another application example of the present invention.
Figure 16:
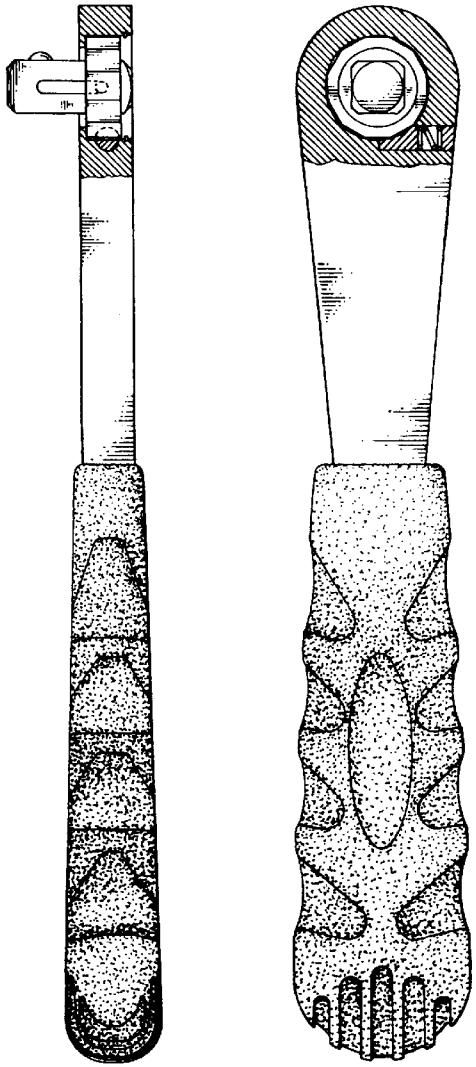
FIG. 16 shows still another application example of the present invention.
Figure 19:
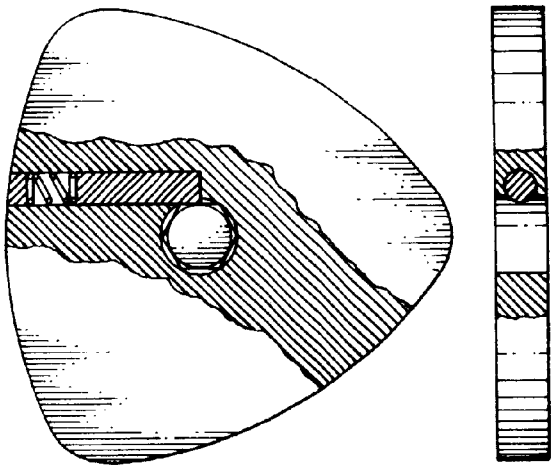
FIG. 19 is similar to FIG. 18 but showing the different detour of the wrench.
Figure 18:
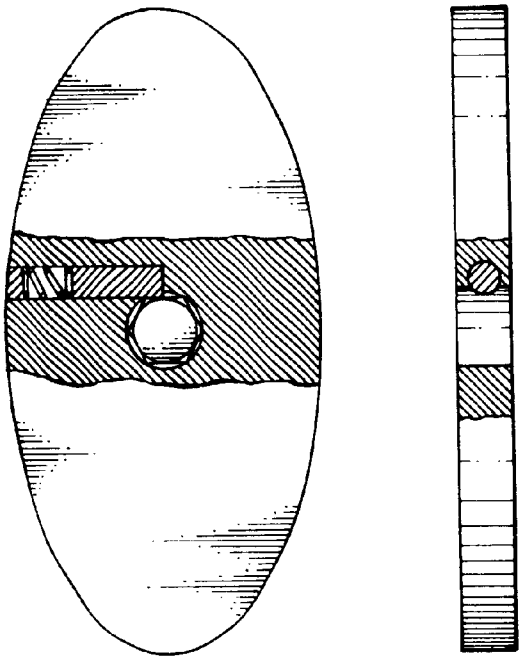
FIG. 18 is a sectional view showing the direction control arrangement used in a wrench of oval cross section, the stop member engaged with the inserted bit.

Referring to FIGS. 14 and 15, the stop member 13 had an engagement notch 131 fitting the polygonal periphery of the bit (or workpiece) ○. Further, the wrench to which the invention is applied can have any of a variety of shapes as shown in FIGS. from 14 through 19.

What is claimed is:

1. A direction control arrangement for a wrench, comprising a body defining a box and a transverse through hole extending across said box, two stop elements respectively mounted in said transverse through hole at two opposite sides of said box, two steel balls respectively mounted in two distal ends of said transverse through hole, two spring members respectively mounted in said transverse through hole and connected between said stop elements and said steel balls to push said stop elements and said steel balls outwards in reversed directions, and a resilient retainer ring mounted around a periphery of said body to prevent said steel balls from escaping out of said body, said resilient retainer ring comprising two protruded receiving portions adapted to receive said steel balls alternatively for controlling a working direction of the wrench.

* * * * *